US007244139B2

(12) United States Patent
Ono et al.

(10) Patent No.: US 7,244,139 B2
(45) Date of Patent: Jul. 17, 2007

(54) ELECTRIC CONNECTOR AND METHOD FOR MANUFACTURING THE SAME

(75) Inventors: Yasuhiro Ono, Tokyo (JP); Akiyoshi Oshitani, Saitama (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 11/482,768

(22) Filed: Jul. 10, 2006

(65) Prior Publication Data

US 2007/0010110 A1 Jan. 11, 2007

(30) Foreign Application Priority Data

Jul. 11, 2005 (JP) ..... 2005-201312

(51) Int. Cl.
*H01R 11/20* (2006.01)
*H01R 4/26* (2006.01)
*H01R 4/24* (2006.01)

(52) U.S. Cl. ..... 439/417; 439/495

(58) Field of Classification Search ..... 439/391, 439/499, 492, 417, 418, 425, 495, 660, 393
See application file for complete search history.

(56) References Cited

U.S. PATENT DOCUMENTS 4,202,595 A * 5/1980 Inouye et al. ..... 439/493

FOREIGN PATENT DOCUMENTS

JP 11-345640 12/1999

* cited by examiner

*Primary Examiner*—Javaid H. Nasri
(74) *Attorney, Agent, or Firm*—Morgan, Lewis & Bockius LLP

(57) ABSTRACT

A plug body is adapted to be fitted into a socket body in a first direction, and formed with a groove extending in a second direction perpendicular to the first direction. Each of plug contacts has a first contact piece and a second contact piece opposing to each other with a gap therebetween. The plug contacts are arrayed such that the first contact piece and the second contact piece are disposed in the groove. Each of projections is extended from the first contact piece so as to oppose the second contact piece, and is formed with a slant face so that a thickness thereof is reduced toward a distal end thereof. The slant faces of the projections form V-shaped lines when the projections are viewed from the first direction.

5 Claims, 12 Drawing Sheets

ELECTRIC CONNECTOR AND METHOD FOR MANUFACTURING THE SAME

BACKGROUND OF THE INVENTION

The present invention relates to an electric connector suitable for press-connecting a sheathed wire, and a method for manufacturing such an electric connector.

An electronic instrument, which has been desired to be reduced in size particularly thickness in height, often employs a sheathed wire (which is hereinafter referred to as a cable) as a wiring member, in which two or more conductive wire elements are twisted together to form a core conductor and the periphery of the core conductor is covered with an insulative sheath. As a method for connecting such cables, Japanese Patent Publication No. 11-345640A discloses an electric connector which collectively press-connects two or more cables without using soldering.

Specifically, the above electric connector comprises: a housing formed with an opening; a plurality of contacts, each of which is formed with a blade portion, arranged within the housing; and a cover-shaped presser movably supported on the housing. A plurality of cables are inserted into the housing from the opening. When the presser is moved so as to close the opening, each of the cables is pressed against the blade portion of an associated one of the contacts, thereby collectively connecting the cables with the contacts.

In an electronic instrument of which cost reduction is required, there has been also increasing the need for enhancement in the efficiency of the connecting operation of an electric connector used in the interior of the electronic instrument. Therefore, it is desired that the electric connector is able to cope with this need as well as can enhance the reliability of the connection thereof.

In the above publication, it is described that the blade portion may extend perpendicularly to or in parallel to the cable inserted in the housing. In a case where the blade portion extends perpendicularly to the cable and a strong pressing force is applied by the actuation of the presser, a blade edge of the blade portion may excessively bite into the core conductor, thereby deteriorating the conductivity of the core conductor or, in an extreme case, cutting off the core conductor. In a case where the blade portion extends in parallel to the cable, the blade edge tends to slip on the periphery of the cable sideways, so that the blade edge cannot bite into the core conductor properly and a reliable electrical connection cannot be established. Especially when a solid sheathe is used to enhance the stiffness of the cable, such slip is likely to occur more easily.

The above electric connector further comprises a connecting member adapted to connected with a contact of a mating connector, and extending in parallel to the blade portion. In a case where the electric connector is disposed on a circuit board such that the connecting member is made parallel to the circuit board, an installation area including the mating connector becomes large, thereby hindering the size reduction requirement.

SUMMARY OF THE INVENTION

It is therefore an object of the invention to provide an electric connector and a method for manufacturing such an electric connector which can facilitate the connecting operation, can enhance the reliability of connection with cables, and can save space for the mounting area of the connector.

In order to achieve the above object, according to the invention, there is provided an electric connector, comprising:

a plug member, adapted to be fitted into a socket body in a first direction, the plug member comprising:

a plug body, formed with a groove extending in a second direction which is perpendicular to the first direction; and a plurality of plug contacts, each of which comprises a first contact piece and a second contact piece opposing to each other with a gap therebetween, the plug contacts being arrayed in the second direction such that the first contact piece and the second contact piece are disposed in the groove;

a plurality of first projections, each of which is extended from the first contact piece of each of the plug contacts so as to oppose the second contact piece, and is formed with a slant face so that a thickness thereof is reduced toward a distal end thereof;

a wiring member, in which a plurality of core conductors arrayed in the second direction and covered with an insulating sheath, the wiring member including a first portion adapted to be inserted into the groove in the first direction; and a presser, having a first part extending in the first direction, and attached to the plug body such that the first part is inserted into the groove, thereby pressing the first portion of the wiring member against the first contact piece in a third direction which is orthogonal to the first direction and the second direction, wherein:

the first contact piece and the second contact piece are resiliently deformable in the third direction, so that the first projections bite into an associated one of the core conductors in the first portion of the wiring member, and the first portion of the wiring member is resiliently clamped between the first contact piece and the first part of the presser; and the slant faces of the first projections form V-shaped lines when the first projections are viewed from the first direction.

With the above configuration, each of the core conductors is guided into the position between the slant faces. The core conductor is then slid on the slant faces and is eventually clamped (preferably, press-fitted) between the first projections while receiving a pressing force from the first contact piece. Since the core conductors are brought into press contact with the first projections with the aid of the resilient repulsion force from the insulating sheath, the core conductors are satisfactorily connected to the plug contacts without soldering.

The presser may comprise a second part continued from the first part thereof and extending in the third direction. The wiring member may comprise a second portion adapted to be bent by the second part of the presser so as to extend in the third direction. The first contact piece may comprise a second projection extending in the first direction and adapted to bite into associated one of the core conductors in the second portion of the wiring member.

With this configuration, there is achieved the function of preventing the wiring member from being withdrawn from the plug body even when an external pulling force is accidentally applied to the second portion of the wiring member.

A part of the second contact piece may be exposed at an outer face of a side wall of the plug body to be electrically connected with the socket body.

With this configuration, in a case where the plug member is fully buried within the socket body when the plug body is fitted into the socket body in which substantially U-shaped socket contacts are disposed, the plug contacts and the socket contacts are electrically connected by merely fitting the plug body into the socket body. In comparison with the configuration disclosed in the above publication, the dimension in the lateral direction (i.e., the mounting area of the electric connector on a circuit board) can be reduced.

An electrically insulative layer may be provided on a face of the first part of the presser which is adapted to face the first groove.

With this configuration, it is easy to avoid the occurrence of an electric short between the core conductor and the presser even when the core conductor receives an excessive pressing force from the first contact piece.

A plurality of protrusions may be formed on an outer face of the insulating sheath in the first portion of the wiring member which is adapted to face the first contact piece. Each of the protrusions may oppose an associated one of the core conductors through the insulating sheath.

With this configuration, since each of the protrusions is first placed between the first projections of each of the plug contacts, associated ones of the core conductors and the plug contacts are reliably connected together.

According to the invention, there is also provided a method of manufacturing a plug contact adapted to be incorporated in a plug member of an electric connector, comprising:

preparing a metal sheet;

blanking out a contact body from the metal sheet such that the contact body comprises a first contact piece and a second contact piece opposing to each other with a gap therebetween, and such that a plurality of projections are extended from the first contact piece toward the second contact piece; and rolling each of the projections to reduce a thickness thereof toward a distal end thereof, thereby forming a slant face thereon, wherein the projections are rolled from different directions so that the slant faces form V-shaped lines when the projections are viewed from a direction orthogonal to the direction that the projections are extending.

With this configuration, the manufacturing costs can be reduced in comparison with another manufacturing process such as cutting or grinding process.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described below in detail with reference to the accompanying drawings.

Figure 1:
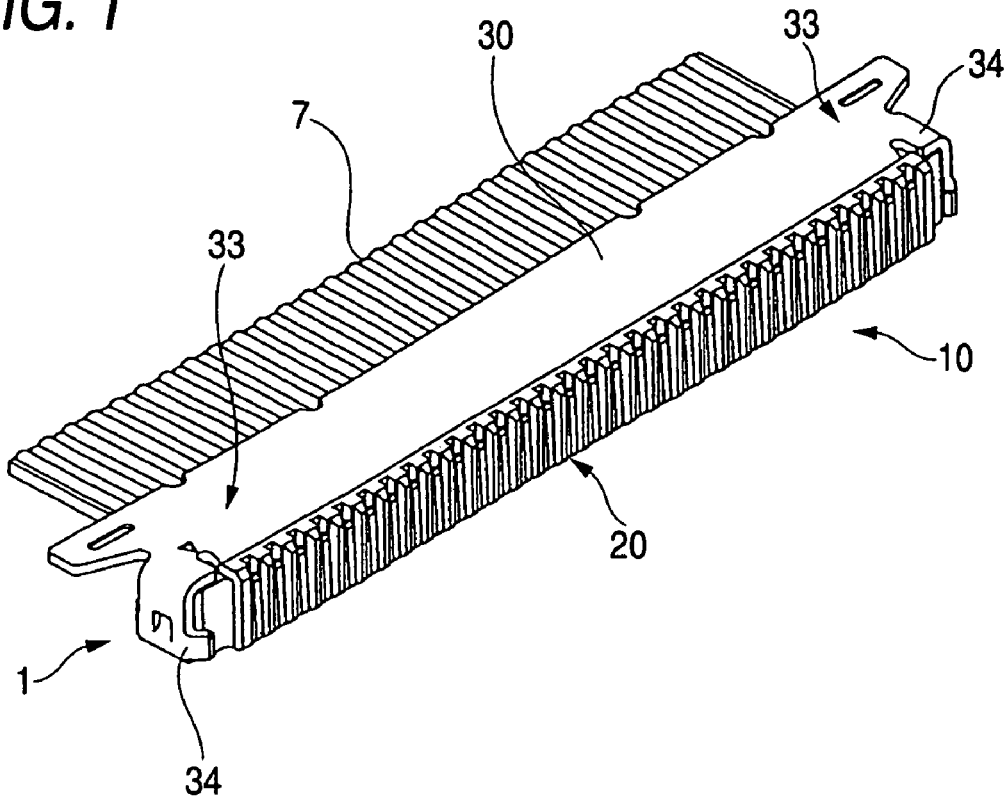
FIG. 1 is a perspective view of a part of an electric connector according to one embodiment of the invention, showing a state that a flat cable and a presser is attached to a plug member to form a plug assembly.

As shown in FIG. 1, a plug member 1 to which a plurality of cables 7 arranged in a flat manner are connected includes an elongated plug body 10 of a generally square in cross-sectional shape. A plurality of plug contacts 20 are arranged at a predetermined pitch in a longitudinal direction of the plug body 10. A presser 30 has extended pieces 34 extending respectively from opposite longitudinal end portions 33 thereof, and is attached to an upper side of the plug body 10 to partially cover the cables 7.

Figure 2:
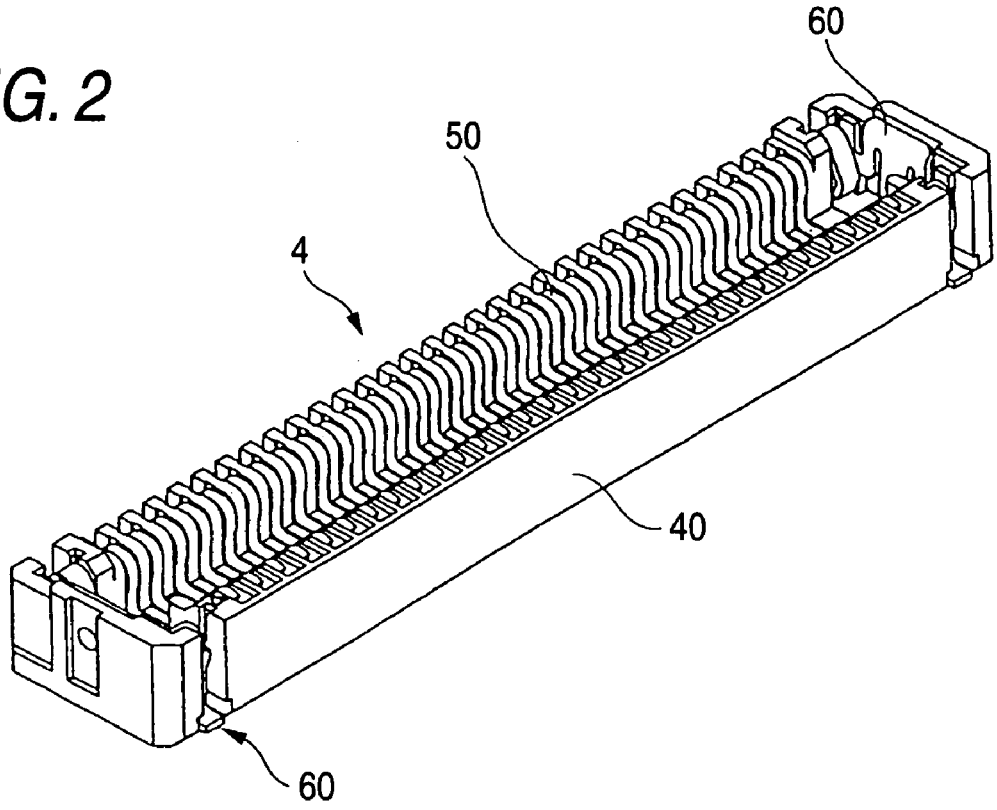
FIG. 2 is a perspective view of a socket member of the electric connector.

As shown in FIG. 2, a socket member 4 includes: an elongated socket body 40 of a generally rectangular cross-sectional shape; a plurality of socket contacts 50 arranged at a predetermined pitch in a longitudinal direction of the socket body 40 in corresponding relation to the arrangement of the plug contacts 20 of the plug member 1; and socket retainers 60 attached respectively to opposite longitudinal ends of the socket body 40 so as to correspond respectively to the extended pieces 34 of the presser 30.

Figure 3A:
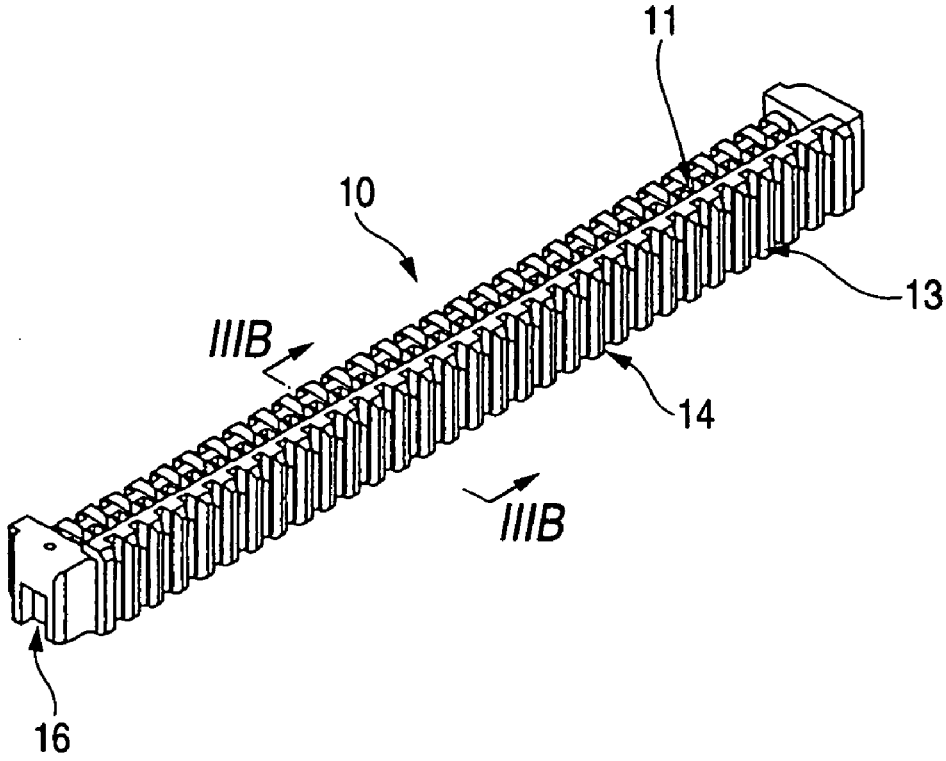
FIG. 3A is a perspective view of a plug body of the plug member.
Figure 3B:
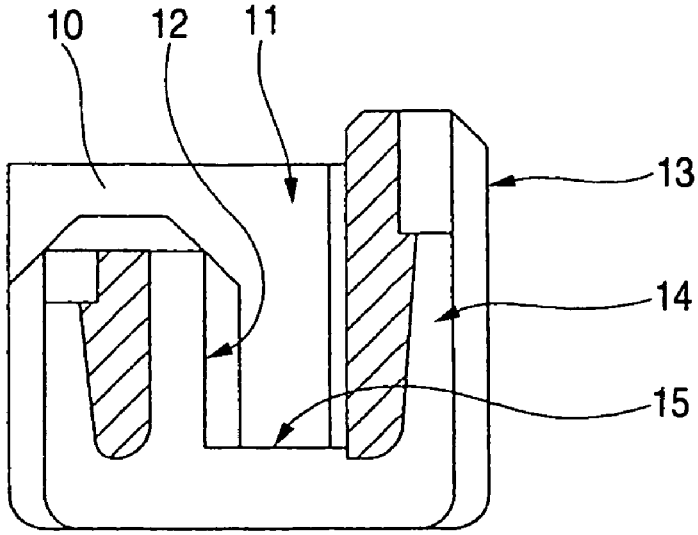
FIG. 3B is a section view taken along a line IIIB-IIIB in FIG. 3A.

As shown in FIGS. 3A and 3B, a groove 11 is formed in the plug body 10 and extends between the vicinities of opposite ends thereof in the longitudinal direction. The groove 11 is open upward such that a bottom 15 of this groove 11 can be viewed from the upper side. Positioning grooves 14 for arranging the plug contacts 20 at the predetermined pitch are formed in an outer face 13 of the plug body 10.

Figure 4:
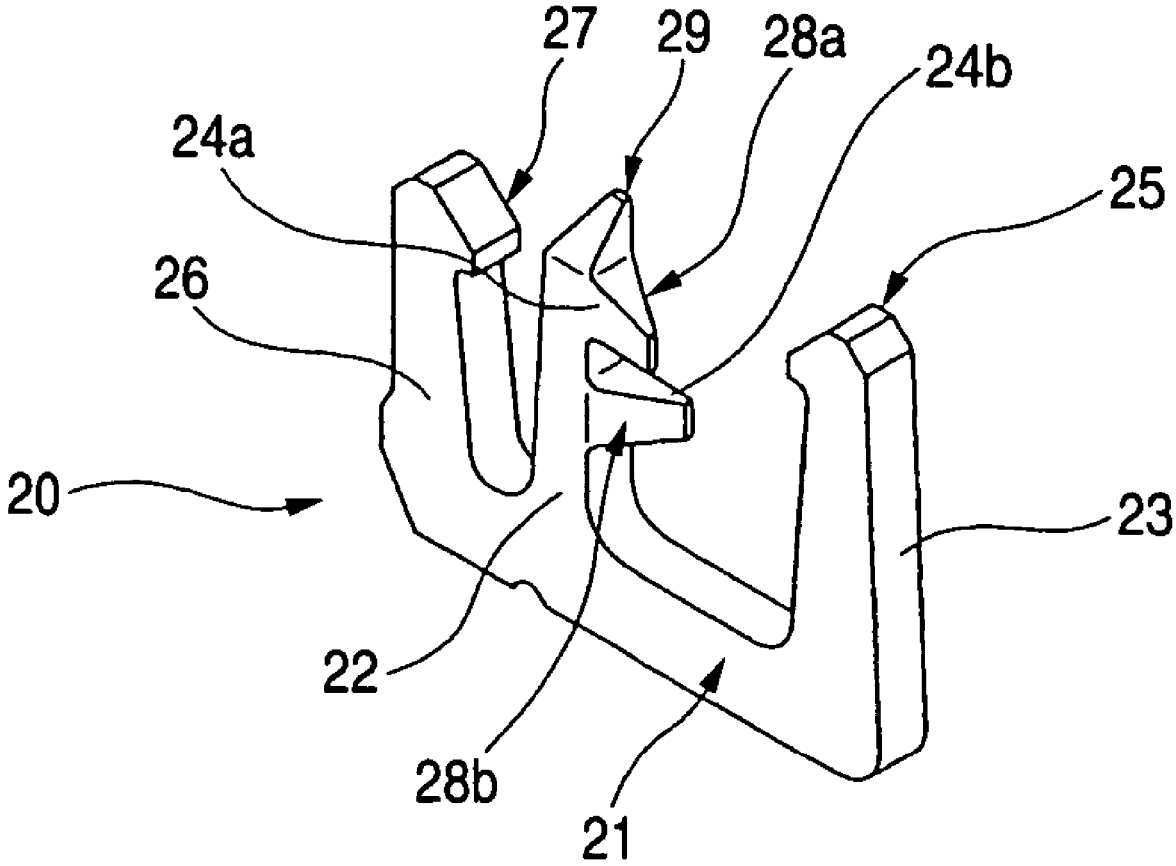
FIG. 4 is a perspective view of a plug contact of the plug member.

The plug contact 20 is blanked out from a thin metal sheet having good electrical conductivity and spring properties. As shown in FIG. 4, the plug contact 20 includes a beam portion 21 connecting a first piece 22, a second piece 23 and a third piece 26. Projections 24*a* and 24*b* are formed on the first piece 22 so as to be adjacent to each other relative to the extending direction of the first piece 22. A projection 25 is formed at a distal end portion of the second piece 23. When a force is applied to move the projections 24*a*, 24*b* and 25 away from each other, the first and second pieces 22 and 23 are resiliently deformed away from each other to thereby produce resilient restoration forces respectively for urging the two pieces 22 and 23 toward each other.

One side face of the projection 24*a* is formed as a slant face 28*a* such that the projection 24*a* is thinned toward a distal end thereof. Similarly, one side face of the projection 24*b* is formed as a slant face 28*b* such that the projection 24*b* is thinned toward a distal end thereof. The slant faces 28*a* and 28*b* are opposed to each other, so that V-shaped lines are formed when they are viewed from above.

The slant faces 28*a* and 28*b* can be easily formed when the plug contact 20 is blanked out. Specifically, in the process that the plug contact 20 is blanked out from the thin metal sheet by an upper mold and a lower mold, the slant faces 28*a* and 28*b* can be formed by rolling the blanked projections 24*a* and 24*b* from above and below. In forming the slant faces, such a rolling process is easier than a cutting process because the number of working steps for the rolling process is less than that for the cutting or grinding process. A projection 29 is also formed on the first piece 22 so as to extend upward.

Figure 5A:
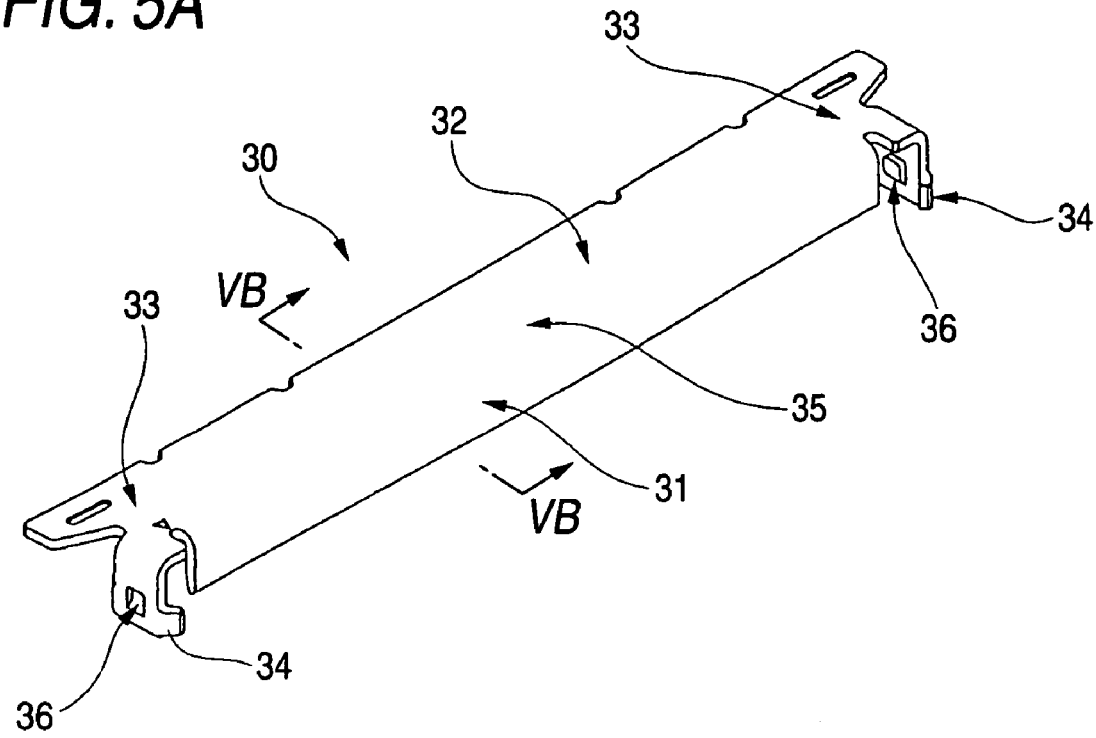
FIG. 5A is a perspective view of the presser.
Figure 5B:
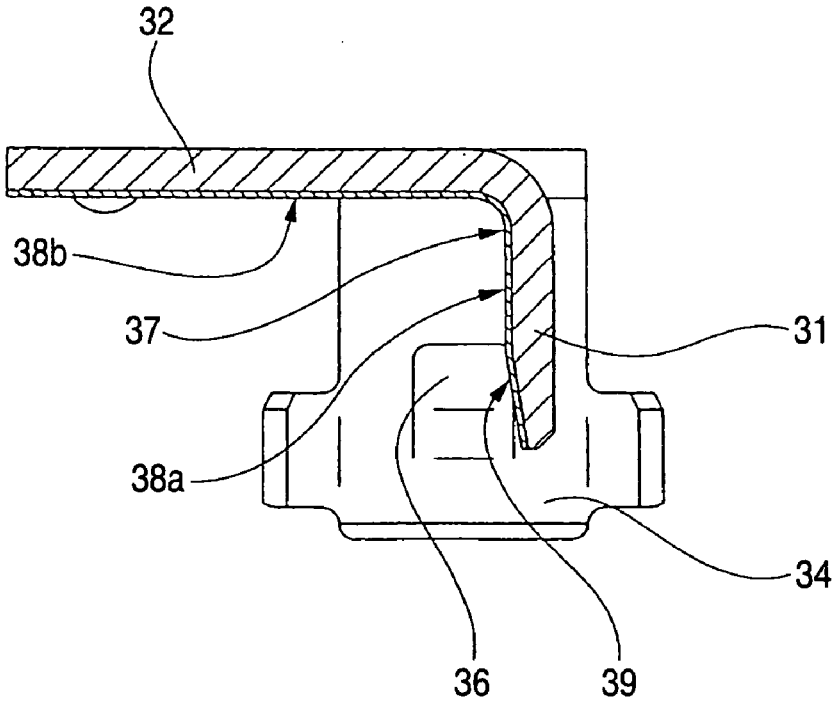
FIG. 5B is a section view taken along a line VB-VB in FIG. 5A.

The presser 30 is formed by blanking out from a thin metal sheet having electrical conductivity and then by bending it into a predetermined shape. As shown in FIGS. 5A and 5B, the presser 30 includes a laterally-extending portion 32, and a vertically-extending portion 31 extending perpendicularly from the laterally-extending portion 32 such that a vertical face 38*a* and a horizontal face 38*b* of an inner face 37 are disposed perpendicular to each other. A length of the vertically-extending portion 31 is slightly smaller than a length of the groove 11 of the plug body 10. The extended pieces 34, each having a window 36, extend downward from the opposite end portions 33 of the laterally-extending portion 32, respectively.

An insulating layer 39 is formed on the inner face 37 of the vertically-extending portion 31 by spraying or coating insulative resin such as epoxy resin paint. The insulating layer 39 may be adhering an insulative resin film on the inner face 37.

Figure 6:
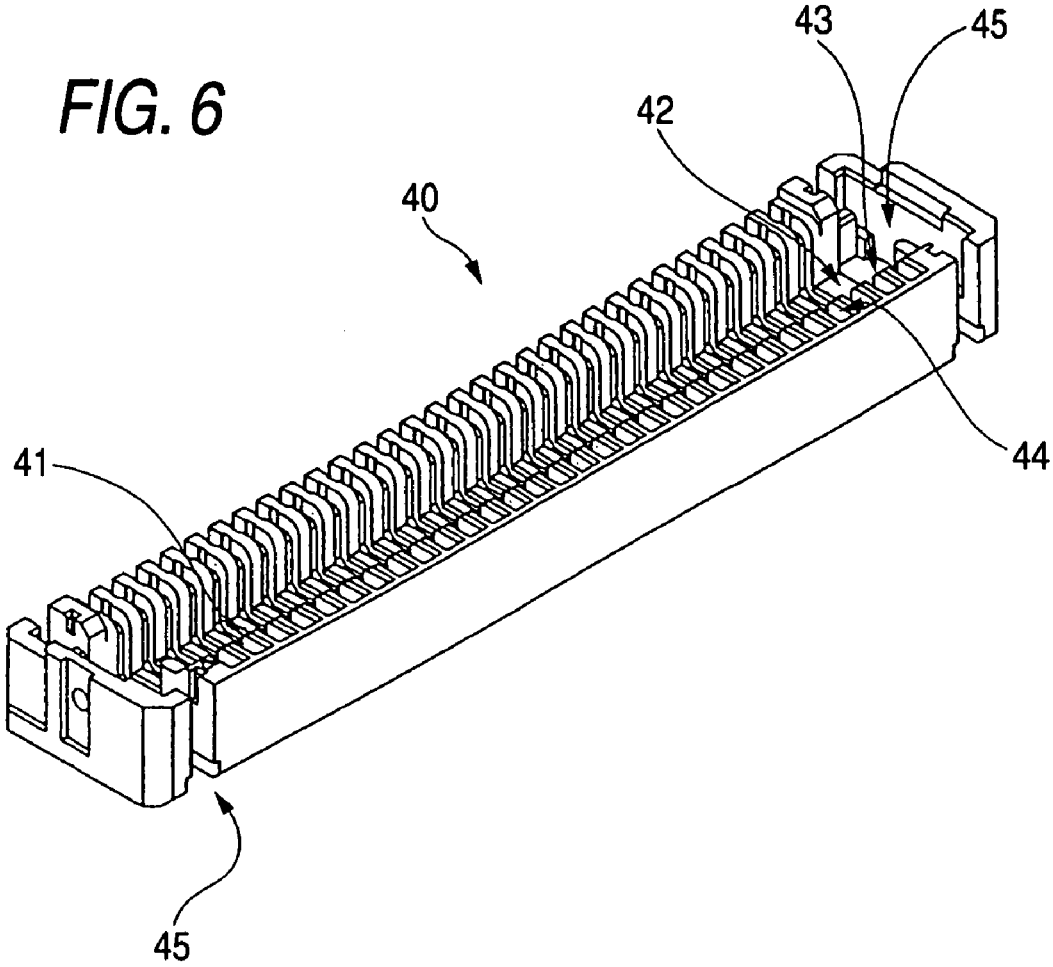
FIG. 6 is perspective view of a socket body of the socket member.

As shown in FIG. 6, an elongated recess for receiving a lower portion of the plug member 1 is formed in the socket body 40, and is opened upward such that a bottom 42 of this elongated recess can be viewed from the upper side. Positioning grooves 44 for arranging the socket contacts 50 at the predetermined pitch corresponding to the arrangement pitch of the plug contacts 20 are formed in an inner face 43 of the elongated recess 41. Mounting grooves 45 are formed in the opposite ends of the socket body 40, respectively, and the socket retainer 60 are mounted in these mounting grooves 45, respectively.

Figure 7:
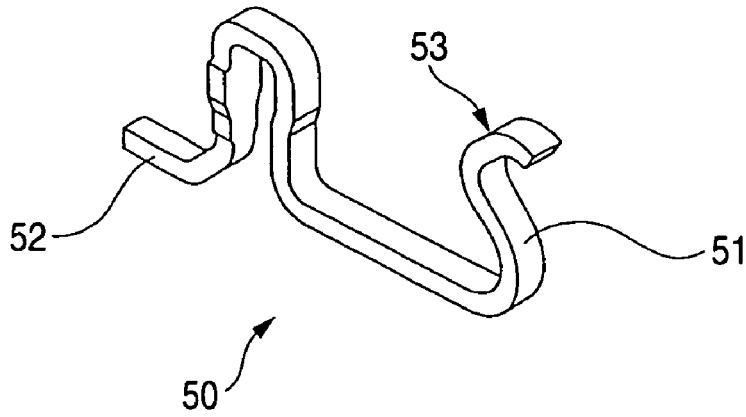
FIG. 7 is a perspective view of a socket contact of the socket member.

The socket contact 50 is blanked out from a thin metal sheet having good electrical conductivity and spring properties. As shown in FIG. 7, the socket contact 50 includes a resilient piece 51 and a laterally-extending tail 52. When the socket member 4 is mounted on a circuit board, the tail 52 is connected and fixed to this circuit board by soldering or the like.

Figure 8A:
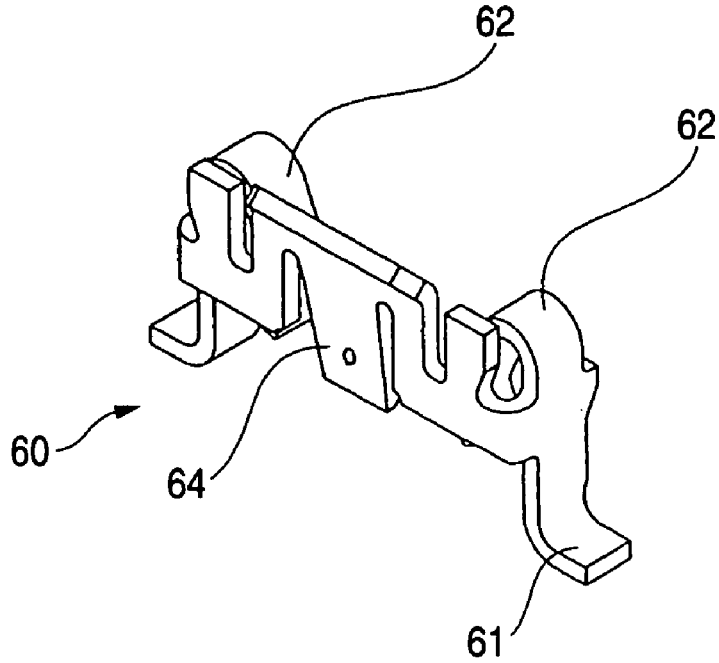
FIGS. 8A and 8B are perspective views of a plug retainer in the socket member.
Figure 8B:
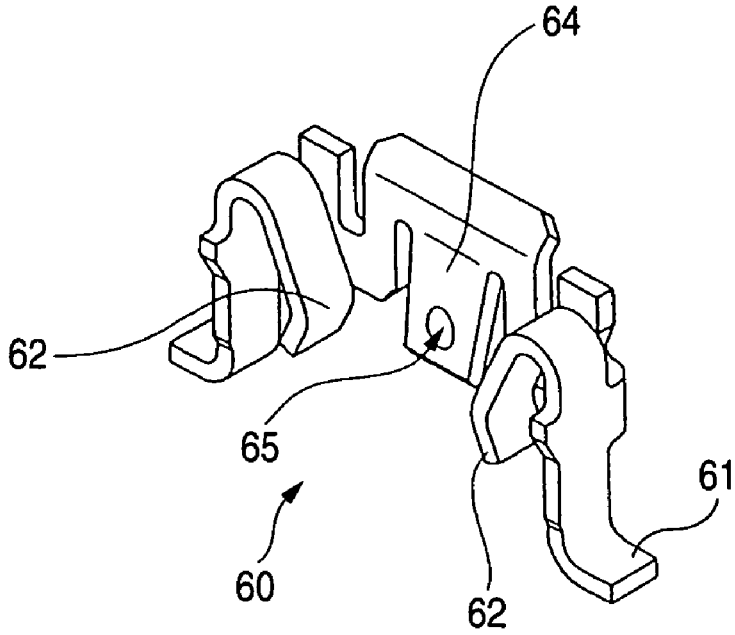

The socket retainer 60 is formed by blanking out from a thin metal sheet having electrical conductivity and then by bending it into a predetermined shape. As shown in FIGS. 8A and 8B, the socket retainer 60 includes a pair of opposed retaining pieces 62 and a laterally-extending tail 61. When the socket member 4 is mounted on the circuit board, the tail 61 is connected and fixed to this circuit board (and is electrically connected thereto if necessary) by soldering or the like. The distance between the retaining pieces 62 is so determined that they can be engaged with the extended piece 34 of the presser 30 when the plug member is inserted and fitted in the socket member. Preferably, the extended piece 34 can be held between the retaining pieces 62. In addition, in the middle portion of the plug retainer 60 that connects together the retaining pieces 62, there is further provided a retaining piece 64 formed with a protrusion 65.

Figure 9A:
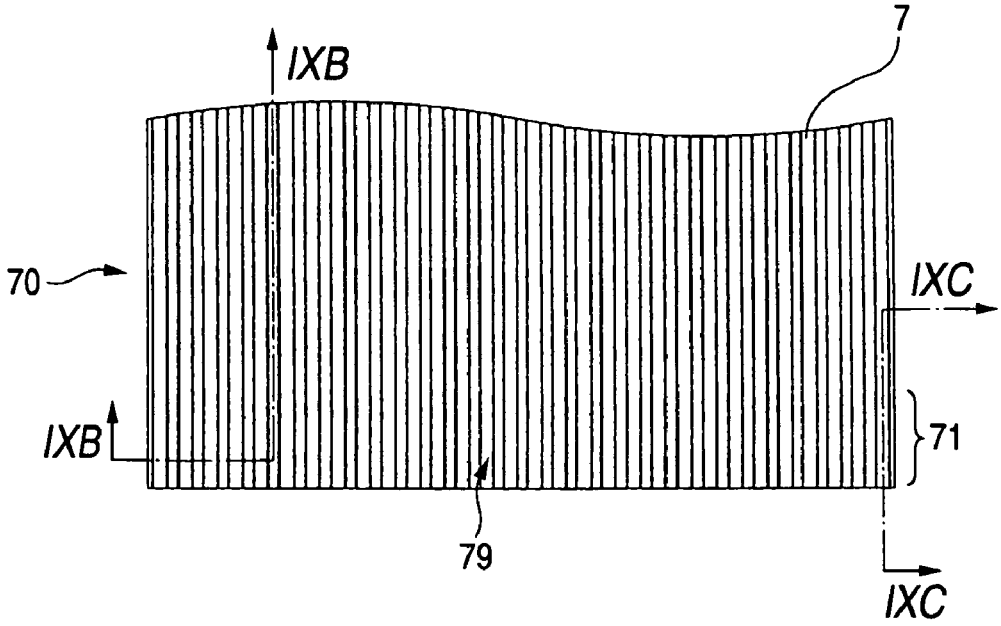
FIG. 9A is a plan view of the flat cable.
Figure 9B:
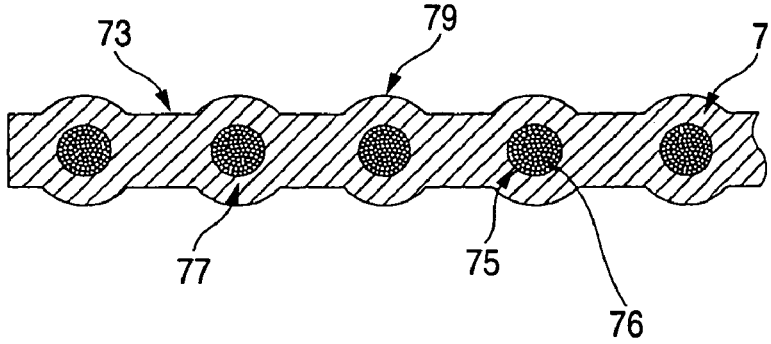
FIG. 9B is a section view taken along a line IXB-IXB in FIG. 9A.
Figure 9C:
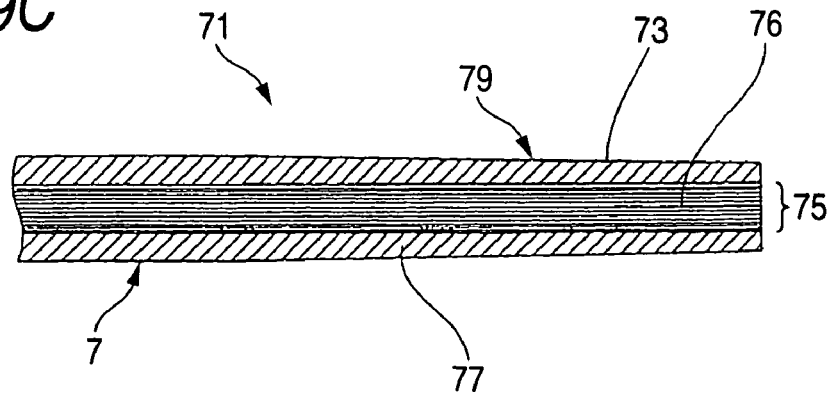
FIG. 9C is a section view taken along a line IXC-IXC in FIG. 9A.

As shown in FIGS. 9A to 9C, each of the cables 7 comprises a core conductor 75 composed of a plurality of conductive wire elements 76 such as soft copper wires twisted together, and an insulating sheath 77 made of an insulative resin material such as vinyl or a fluororesin covering the core conductor 75. A plurality of cables 7 are joined by bonding, thermal fusion or the like in such a manner that their core conductors 75 are arranged at equal intervals corresponding to the arrangement pitch of the plug contacts 20 of the plug member 1, thereby forming a flat cable 70. At least on one side face 73 of an end portion 71 of the flat cable 70, protruded portions 79 are formed with a fixed pitch corresponding to the arrangement pitch of the core conductors 75.

Figure 10:
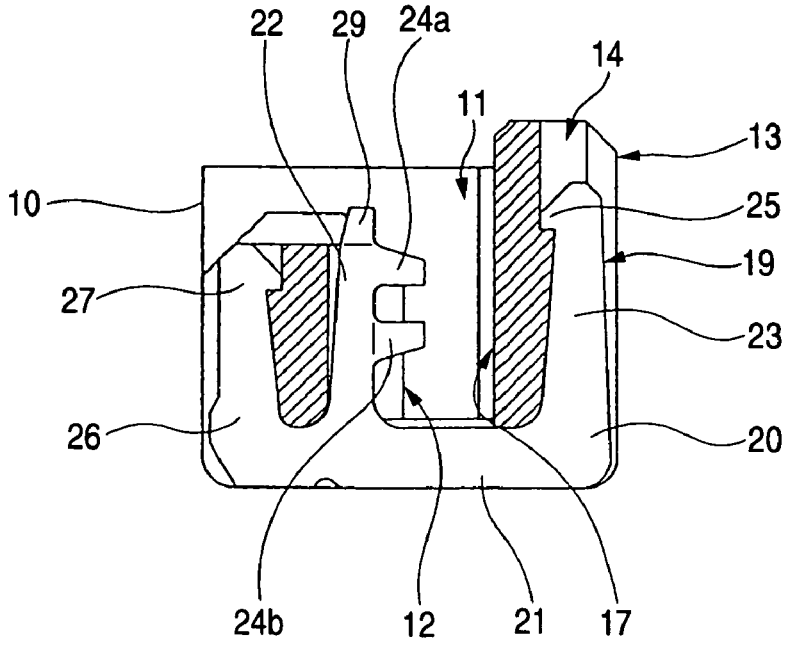
FIG. 10 is a section view showing a state that the plug contact is disposed in the plug body.

As shown in FIG. 10, the plug contact 20 is attached to the plug body 10 from the lower side thereof, and as a result the projections 24*a* and 24*b* of the first piece 22 project from a first inner wall 12 of the groove 11, and also the second piece 23 is guided by the positioning groove 14 in such a manner that a portion 19 is exposed from an outer face 13, and the projection 25 of the second piece 23 and a projection 27 of the third piece 26 clamp the plug body 10. In this condition, the distance (or gap) between the projections 24*a*, 24*b* and a second inner wall 17 which are opposed to each other is slightly smaller than the sum of the thickness of the end portion 71 of each cable 7 and the thickness of the vertically-extending portion 31 of the presser 30. The first piece 22 can be resiliently displaced in the lateral direction because of a spring function of the beam portion 21.

Figure 11:
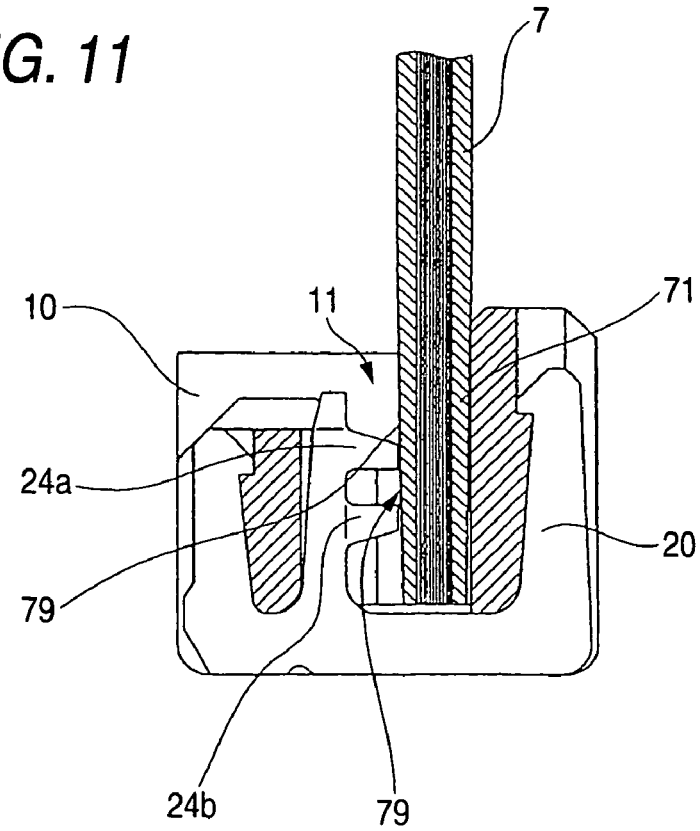
FIG. 11 is a section view showing a state that the flat cable is inserted into the plug body.

FIG. 11 shows a condition in which the end portions 71 of the cables 7 are inserted into the plug body 10 through the opening 11 in such a manner that each of the protruded portions 79 is placed between the projections 24*a* and 24*b*.

Figure 12:
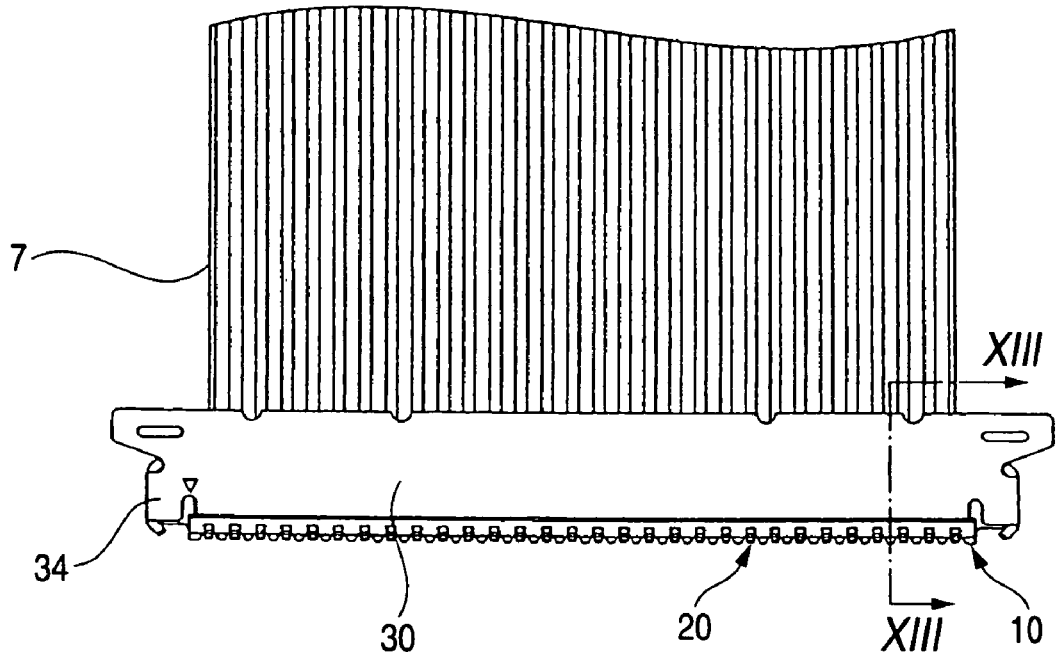
FIG. 12 is a plan view of the plug assembly.
Figure 13:
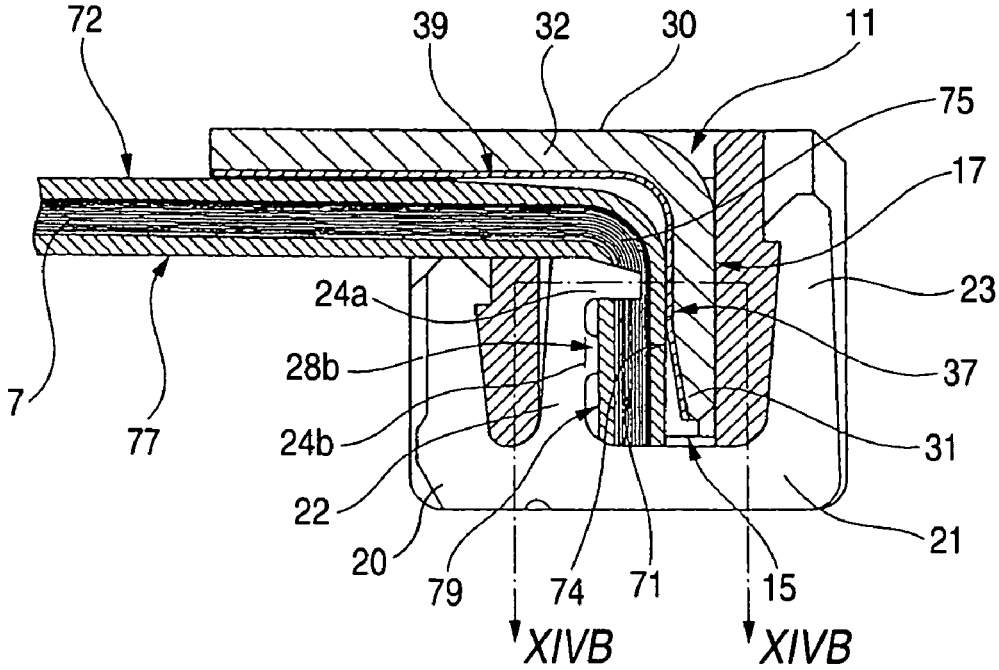
FIG. 13 is section view taken along a line XIII-XIII in FIG. 12.
Figure 14A:
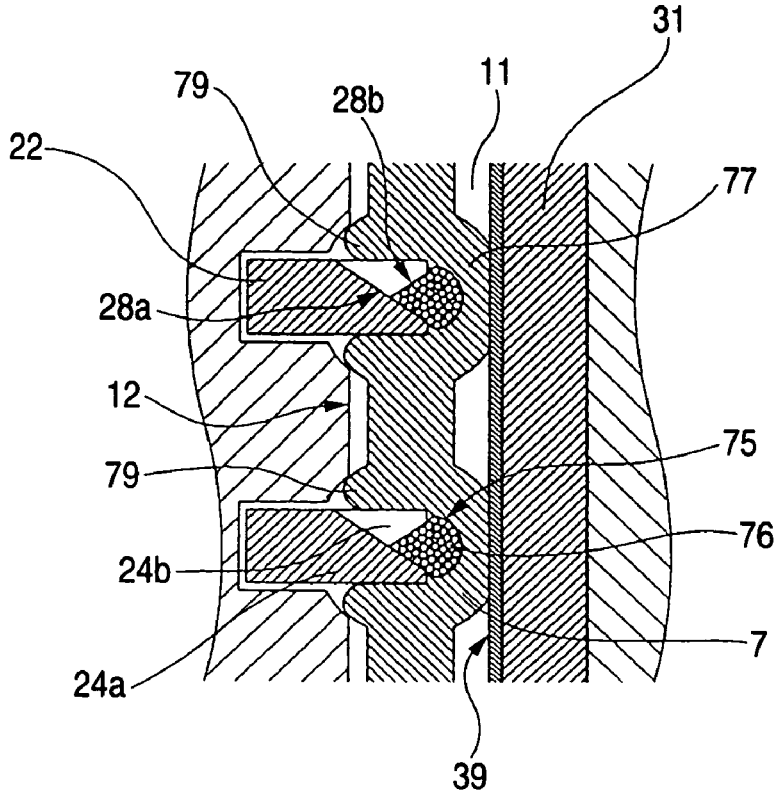
FIG. 14A is a section view taken along a line XIVA-XIVA in FIG. 13.
Figure 14B:
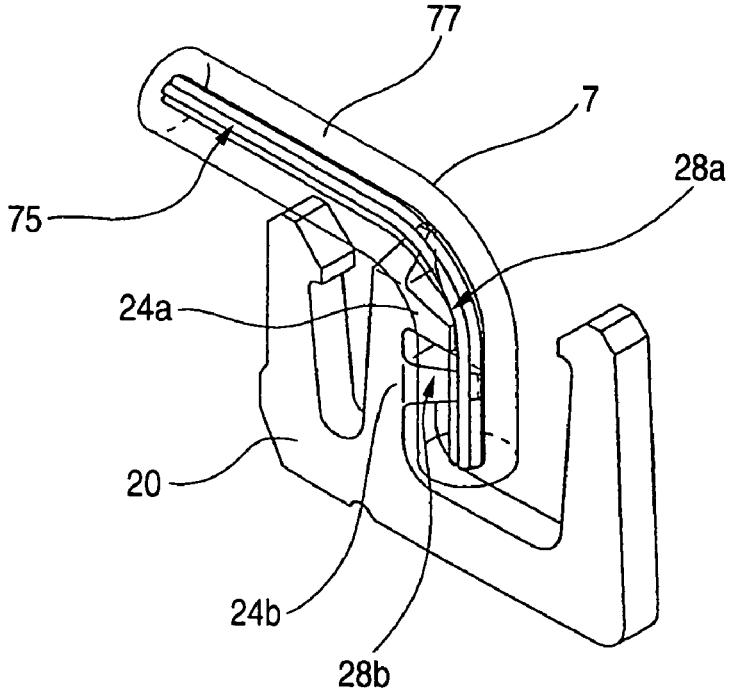
FIG. 14B is a schematic perspective view showing a state that projections formed on the plug contact bite into a sheathed wire constituting the flat cable.

FIGS. 12 and 13 show a condition in which the end portions 71 of the cables 7 and the vertically-extending portion 31 of the presser 30 are inserted into the opening 11 from the upper side toward the bottom 15. The vertically-extending portion 31, which is inserted in the gap between the other side 74 of the end portion 71 of each cable 7 and the second inner wall 17 of the opening 11, presses the core conductor 75 disposed at the end portion 71 and the first piece 22 of the beam portion 21 in the lateral direction (in the left-hand direction in FIG. 13). In this condition, the end portion 71 is firmly held between the vertically-extending portion 31 and the first piece 22 with the aid of the urging effect of the second piece 23 due to the resilient spring function of the beam portion 21.

During the process that the presser 30 is inserted, the protruded portion 79 is first guided into a position between the slant faces 28*a* and 28*b* so that the projections 24*a* and 24*b* bite into the insulating sheath 77. Thus, each of the cables 7 can be properly positioned with respect to an associated one of the plug contacts 20. Next, the core conductor 75 is guided into the position between the slant faces 28*a* and 28*b*. The core conductor 75 is then slid on the slant faces 28*a* and 28*b* and is eventually clamped (preferably, press-fitted) between the projections 24*a* and 24*b* while receiving a pressing force from the first piece 22. Since the conductive wire elements 76 are brought into press contact with the projections 24*a* and 24*b* with the aid of the resilient repulsion force from the insulating sheath 77, the wire elements 76 are satisfactorily connected to the plug contact 20. In this condition, the core conductors 75 of the cables 7 are electrically connected to the respective plug contacts 20 without soldering.

In addition, since the insulating layer 39 is provided on the inner face 37 of the vertically-extending portion 31, it is possible to avoid a situation that the plug contact 20 and the vertically-extending portion 31 are electrically connected unintentionally even when the core conductor 75 receives the pressing force from the first piece 22 excessively and a distance between the projections 24*a*, 24*b* and the vertically-extending portion 31 is reduced (in an extreme case, even when the projections 24*a* and 24*b* come in contact with the vertically-extending portion 31). The end portions 71 of the cables 7 are covered and bent by the laterally-extending portion 32 of the presser 30, and the second blade portion 29 of the first piece 22 of each plug contact 20 abuts against the inner side or face of this bent portion of the cable 7 (in biting relation to the insulating sheath 77). With this arrangement, there is achieved the function of preventing the cable 7 from being withdrawn even when an external pulling force is accidentally applied to a portion 72 extending laterally (in a left-hand direction in FIG. 13) from the end portion 71 of the cable 7.

Figure 15:
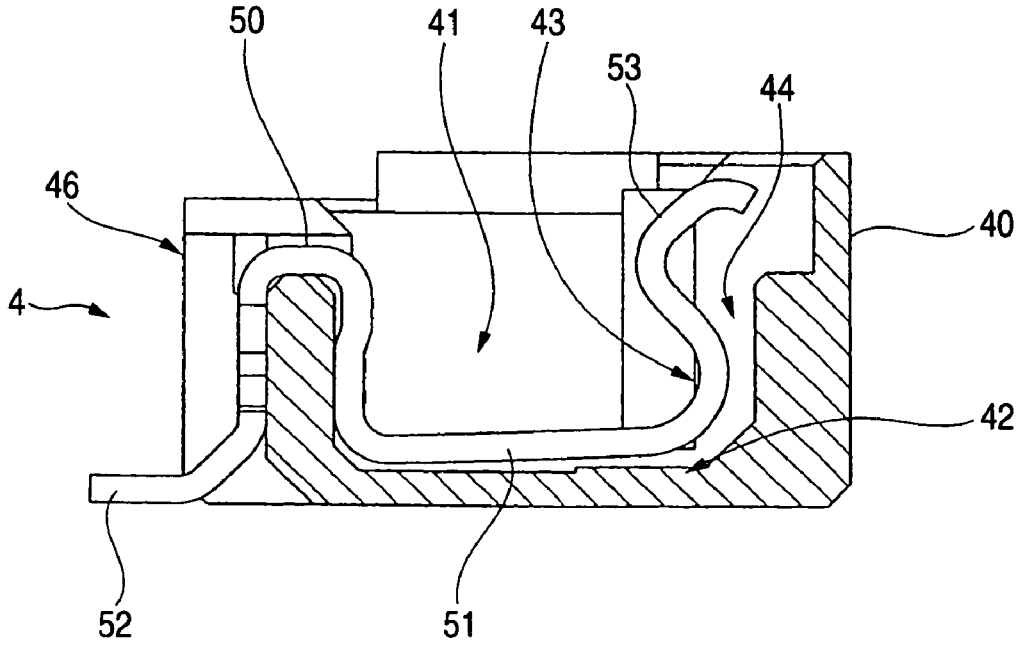
FIG. 15 is a section view showing a state that the socket contact is disposed in the socket body.

As shown in FIG. 15, each socket contact 50 is mounted in the socket body 40 in such a manner that a projection 53, formed at the distal end portion of the resilient piece 51, projects from an inner face 43 of the elongated recess and that the tail 52 projects from an outer face 46 of the socket body 40. In this condition, the projection 53 of the resilient piece 51 can be resiliently displaced in the lateral direction, that is, in such a direction that spreads the resilient piece 51.

Figure 16:
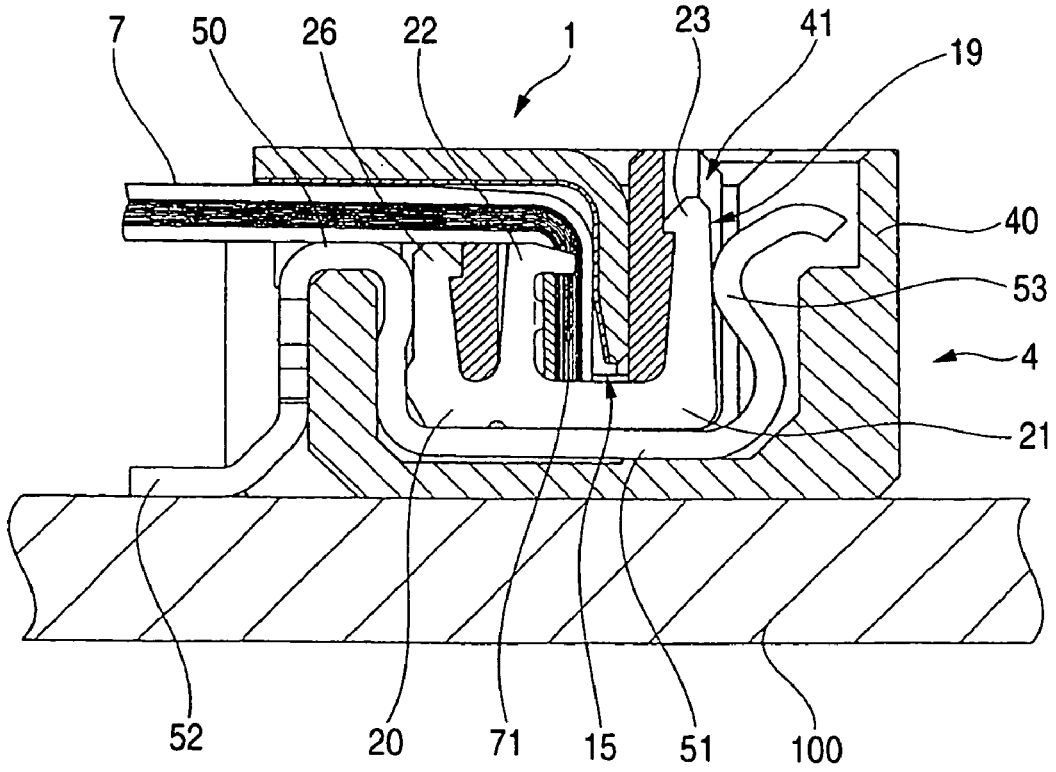
FIG. 16 is a section view showing a state that the plug assembly is disposed on a circuit board.

FIG. 16 shows a condition in which the plug member 1, having the cables 7 connected thereto, is inserted and fitted into the socket member 4 mounted on a circuit board 100 having arbitrary wiring formed thereon. The plug member 1 inserted into the elongated recess 41 of the socket body 40 with the bottom 15 being directed downward is fitted in the socket member 4 in such a manner that the resilient piece 51 of each socket contact 50 grips the second piece 23 and third piece 26 of the corresponding plug contact 20. In this condition, the projection 53 of the resilient piece 51, resiliently displaced in the lateral direction (in the right-hand direction in FIG. 16), presses the second piece 23 by its resilient force produced by the resilient spring function of the resilient piece 51, so that the plug contact 20 and the socket contact 50 are electrically connected together in such a manner that an exposing portion 19 and the projection 53 abut against each other. This fitting construction in which the plug member 1 is almost completely received within the socket member 4 facilitates reduction of the height of the electric connector (from the upper face of the circuit board 100 to the top face of the plug member 1) in its completely-fitted condition. And besides, the connector mounting area can be easily provided in a space-saving manner as compared with the above-mentioned conventional example in which the mating connector is provided in a manner that it extends laterally from its connecting portion.

A method of manufacturing the end portions 71 of the cables 7 will be explained with reference to FIGS. 17A and 17B.

Figure 17A:
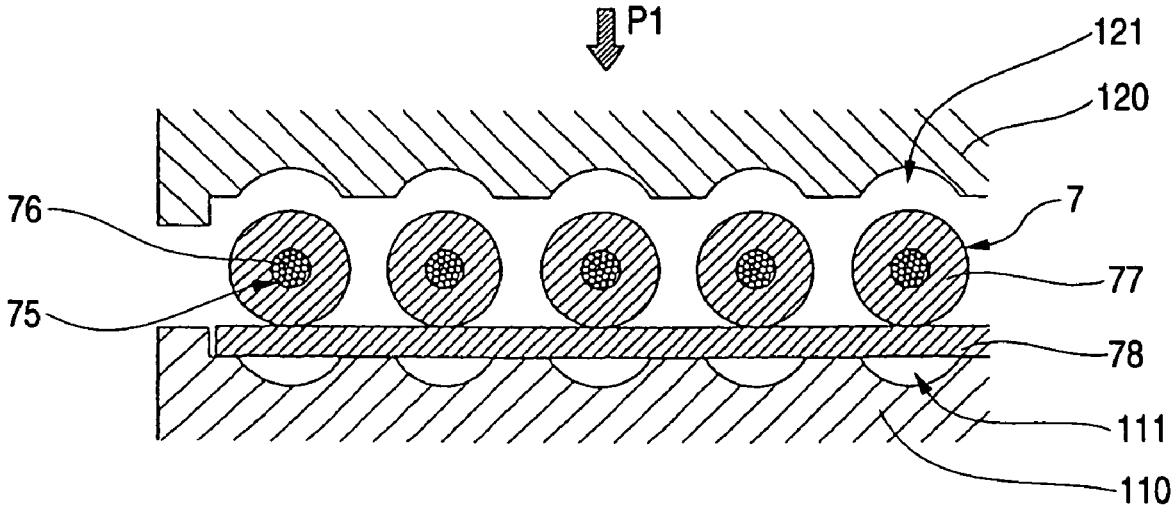
FIGS. 17A and 17B are section views showing how to manufacture the flat cable.
Figure 17B:
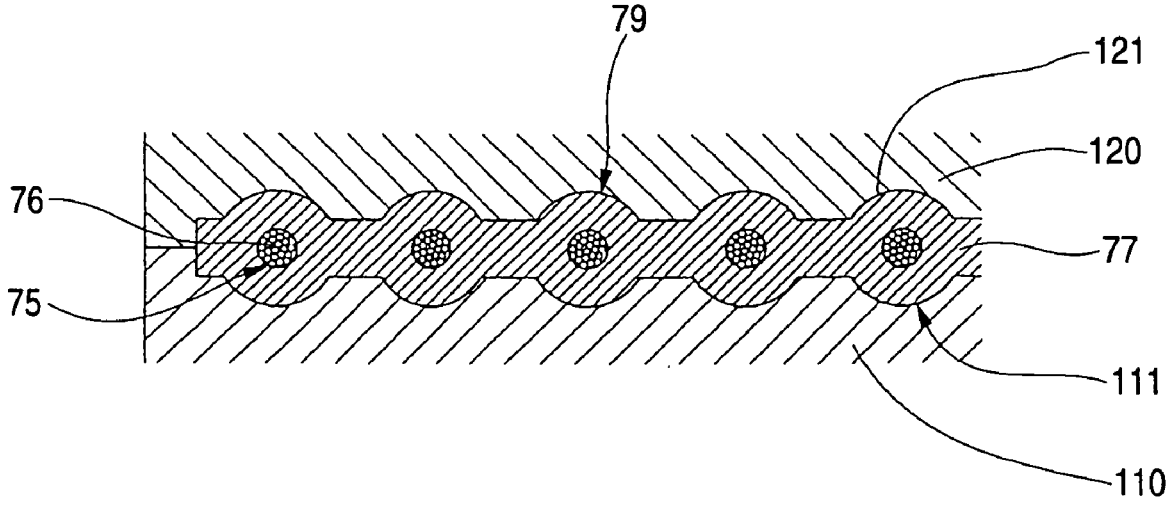

In FIG. 17A, a sheet material 78 preferably made of the same material as that of the insulating sheath 77 is placed on a first mold 110, and a plurality of cables 7 are arranged on the sheet material 78 in such a manner that their core conductors 75 are arranged at the predetermined pitch. The first mold 110 has recesses 111 which are formed in an upper face thereof, and are arranged at a pitch corresponding to the pitch of the core conductors 75. A second mold 120 is located above the first mold 110, and can be pressed down or moved downward in a direction P1. The second mold 120 has recesses 121 which are formed in a lower face thereof facing the upper face of the first mold 110, and are arranged at a pitch corresponding to the pitch of the core conductors 75.

A heater such as an electric heater (not shown) is provided in at least one of the first mold 110 and the second mold 120. The cables 7 and the sheet material 78 are held between the first mold 110 and the second mold 120 in a squeezed manner, and are formed or molded into a generally flattened shape with the aid of a heating effect of the heater in such a manner that the insulating sheaths 77 and the sheet material 78 are fused as shown in FIG. 17B.

In the next step, when the second mold 120 is moved upward, the thin multi-core conductor cable, having the protruded portions 79 are arrayed with the predetermined pitch corresponding to the arrangement pitch of the core conductors 75, remains on the first mold 110.

In this embodiment, two projections 24*a* and 24*b* are provided on the first piece 22 and the slant faces 28*a* and 28*b* face different directions. However, three or more projections may be provided. In this case, it is preferable that slant faces formed on the projections face different directions alternately. That is, if a third projection is formed above the projection 24*a*, a slant face formed thereon faces the same direction as the slant face 28*b*. Nevertheless, another configuration may be adopted because the desired effect can be attained if only the V-shaped lines are formed by the slant faces.

In the above embodiment, each of the protruded portions 79 of the flat cable 70 has a semicircular cross section. However, each of the protruded portions 79 may have a triangular cross section. Further, in a case where core conductors having different diameters are arranged in the flat cable 70, the size of the protruded portions 79 may be varied accordingly.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An electric connector, comprising:

a plug member, adapted to be fitted into a socket body in a first direction, the plug member comprising:

a plug body, formed with a groove extending in a second direction which is perpendicular to the first direction; and a plurality of plug contacts, each of which comprises a first contact piece and a second contact piece opposing to each other with a gap therebetween, the plug contacts being arrayed in the second direction such that the first contact piece and the second contact piece are disposed in the groove;

a plurality of first projections, each of which is extended from the first contact piece of each of the plug contacts so as to oppose the second contact piece, and is formed with a slant face so that a thickness thereof is reduced toward a distal end thereof;

a wiring member, in which a plurality of core conductors arrayed in the second direction and covered with an insulating sheath, the wiring member including a first portion adapted to be inserted into the groove in the first direction; and a presser, having a first part extending in the first direction, and attached to the plug body such that the first part is inserted into the groove, thereby pressing the first portion of the wiring member against the first contact piece in a third direction which is orthogonal to the first direction and the second direction, wherein:

the first contact piece and the second contact piece are resiliently deformable in the third direction, so that the first projections bite into an associated one of the core conductors in the first portion of the wiring member, and the first portion of the wiring member is resiliently clamped between the first contact piece and the first part of the presser; and the slant faces of the first projections form V-shaped lines when the first projections are viewed from the first direction.

2. The electric connector as set forth in claim 1, wherein:

the presser comprises a second part continued from the first part thereof and extending in the third direction;

the wiring member comprises a second portion adapted to be bent by the second part of the presser so as to extend in the third direction; and the first contact piece comprises a second projection extending in the first direction and adapted to bite into associated one of the core conductors in the second portion of the wiring member.

3. The electric connector as set forth in claim 1, wherein:

a part of the second contact piece is exposed at an outer face of a side wall of the plug body to be electrically connected with the socket body.

4. The electric connector as set forth in claim 1, wherein:

an electrically insulative layer is provided on a face of the first part of the presser which is adapted to face the first groove.

5. The electric connector as set forth in claim 1, wherein:

a plurality of protrusions are formed on an outer face of the insulating sheath in the first portion of the wiring member which is adapted to face the first contact piece; and each of the protrusions opposes an associated one of the core conductors through the insulating sheath.

* * * * *